United States Patent [19]

Gartner

[11] 4,018,202

[45] Apr. 19, 1977

[54] HIGH ENERGY ADAPTIVE IGNITION VIA DIGITAL CONTROL

[75] Inventor: Todd Henry Gartner, Elmhurst, Ill.

[73] Assignee: Motorola, Inc., Schaumburg, Ill.

[22] Filed: Nov. 20, 1975

[21] Appl. No.: 633,737

[52] U.S. Cl. ..... 123/148 E; 123/117 R
[51] Int. Cl.[2] ..... F02P 3/04; F02P 5/04
[58] Field of Search ..... 123/148 E, 32, 32 EA

[56] References Cited

UNITED STATES PATENTS

| | | | |
|---|---|---|---|
| 3,908,616 | 9/1975 | Sasayama | 123/32 EC |
| 3,937,193 | 2/1976 | Kim | 123/148 E |

*Primary Examiner*—Stephen C. Bentley
*Assistant Examiner*—Thomas H. Webb
*Attorney, Agent, or Firm*—James W. Gillman; Donald J. Lisa; James P. Hamley

[57] ABSTRACT

A digital system controls ignition dwell for an internal combustion engine. Dwell time is maintained constant, thus assuring a constant high level ignition spark, over the entire active RPM range of the engine. In addition, the system compensates for temperature and aging induced changes in the ignition components.

In operation, one sensor generates pulses representative of engine angular position while a second produces ignition pulses. An angle counter stores the number of position pulses generated thereby creating a count representative of engine position. A speed counter stores the number of position pulses generated for a clock interval, producing a count representative of engine speed. Dwell time is initiated at a predetermined relationship between the counter outputs which assures a constant dwell time. Feedback circuitry monitors current through the ignition coil and alters the clock interval to compensate for ignition component changes.

12 Claims, 3 Drawing Figures

HIGH ENERGY ADAPTIVE IGNITION VIA DIGITAL CONTROL

BACKGROUND OF THE INVENTION

This invention relates to automotive ignition systems and, more particularly, to a digitally implemented, constant dwell time version thereof.

Electronically controlled ignition systems are well known in the art. Such systems are favored over their mechanical counterpart since the electronic system is more accurate and reliable. Basically, the purpose of any ignition system is to generate a spark suitable for firing the combustion chambers at a predetermined engine angular position. In mechanical breaker point type systems it has been found that spark energy falls off at increasing engine RPM. This may result in inefficient fuel combustion or even engine misfiring. The use of electronic circuitry in the ignition can result in a constant spark energy level over the entire range of engine active operation.

While fully electronic ignition systems have resulted in enhanced engine performance, they have suffered certain limitations. For example, in inductive storage type systems, spark energy level is a function of battery voltage and ignition coil resistance. Each of these parameters is temperature dependent, and, in automotive applications, temperature extremes are to be expected. Prior ignition systems have not compensated for these variables.

A further failing in prior art ignition systems is acceleration response. For proper engine operation, an ignition system must environmental and to accelerations of up to 4,000 RPM per second. Electronic ignitions normally have a time lag, which prevents them from being suitably responsive.

In addition, fully electronic ignitions have required a large number of electronic components, resulting in a very expensive system. Moreover, many of the components are temperature dependent and suffer degradation due to aging effects.

SUMMARY OF THE INVENTION

It is an object of this invention, therefore, to provide a fully electronic ignition system which compensates for the evironmental and aging effects of the ignition components.

It is a further object of the invention to provide an ignition as described above which is fully responsive to engine acceleration.

An additional object of the invention is to provide an ignition as described above which requires a minimum of external components.

It is a particular object of the invention to provide a highly accurate and responsive electronic ignition system which is implemented with digital circuitry.

Briefly, according to the invention, sensors in the ignition system provide two types of pulses. The first type is an ignition pulse which occurs synchronous to the desired time of engine combustion chamber firing. Between ignition pulses, a sequence of position pulses is generated. The instance of a position pulse corresponds to a given engine angular position.

First circuitry processes the position pulses whereby an output signal representative of engine position is produced. At the occurrence of an ignition pulse, the first circuitry is reset to a reference level from which it again begins processing the position pulses. In the digital implementation of the invention, the first circuitry is comprises of a resettable position counter.

Second circuitry also processes the position pulses to produce at its output a signal representative of engine RPM. In the preferred embodiment of the invention, the second circuitry is comprised of a clock, a speed counter, and a speed register. The clock generates a signal of predetermined time period which is suitable for activating the speed counter. In its activated state, the speed counter produces an output count representative of the number of position pulses generated during each clock signal. At the conclusion of a clock period, the total count from the speed counter is transferred to the speed register.

A comparator monitors the output count from both the first circuitry, e.g., position counter, and the second circuitry, e.g., the speed register. The comparator produces a trigger signal at a predetermined relationship between the outputs from the first and second circuits. This relationship is such that once a trigger signal is generated, it activates a switch which in turn maintains the ignition system at a constant dwell time and thus a constant spark energy level, provided there is a constant battery voltage and ignition coil resistance.

To compensate for varying component values, such as battery voltage and ignition coil resistance, a means monitors the ignition energy level and generates a feedback signal representative thereof. In a particular embodiment, the feedback signal may be comprised of the synchronous occurrence of a given current level in the ignition coil and generated position pulses. In response to the feedback signal, a control means alters the occurrence of the trigger signal such that dwell time is adjusted to maintain a substantially constant ignition energy level. In the preferred embodiment, the control means responds to the feedback signal to vary the clock period interval. When, for example, the control means detects an increasing current limit feedback signal, such as might happen with decreased coil resistance or increased battery voltage, the clock time period is decreased whereby the comparator institutes dwell at a later time in the engine cycle. In so doing, the feedback provides a fully adaptive constant energy ignition system. Finally, in the preferred embodiment, such component may be implemented by using digital technology, whereby the resulting system comprises a minimum of external components.

BRIEF DESCRIPTION OF THE DRAWINGS

FIG. 3 is a more detailed diagram of the preferred embodiment.

DETAILED DESCRIPTION OF THE PREFERRED EMBODIMENT OF THE INVENTION

Figure 1:
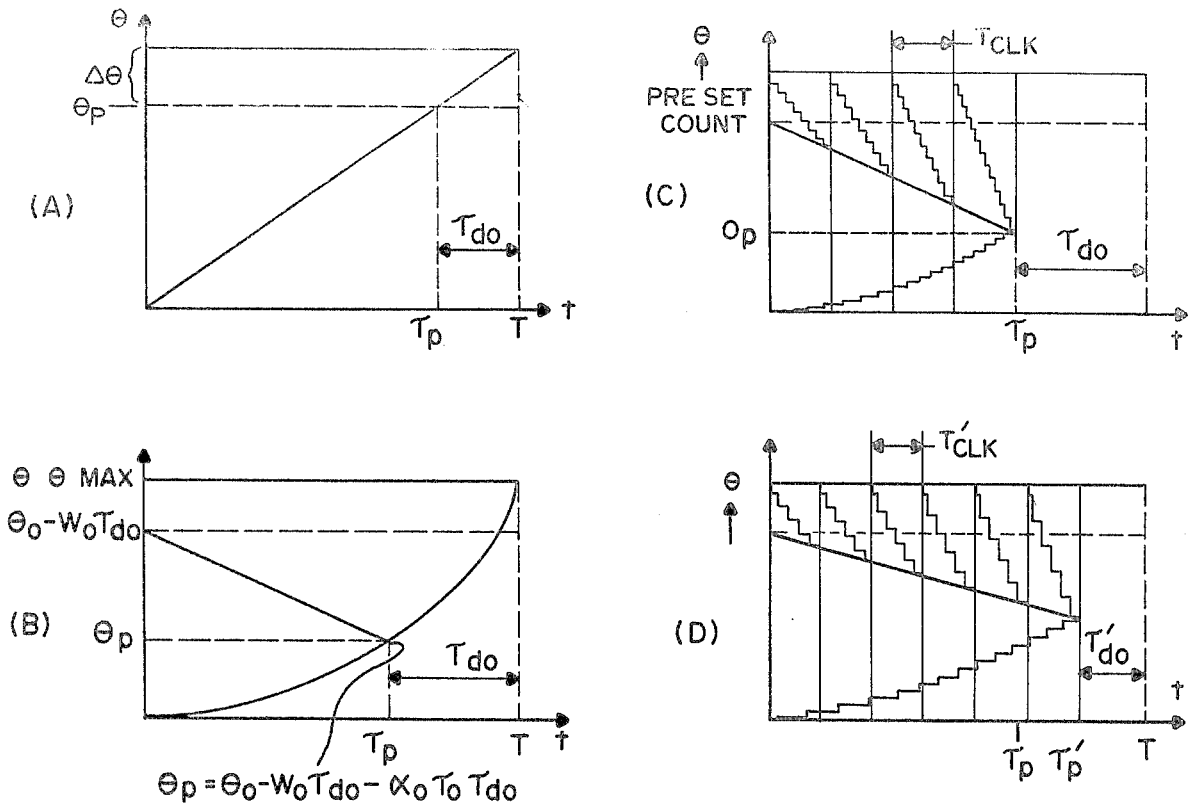
FIG. 1 is a graphical representation of the operation of a system according to the invention.

The present system utilizes both engine position and speed information to maintain a constant ignition energy level. Since the energy of an inductive storage type ignition is a function of dwell time (i.e., the time during which battery current is passed through the coil), dwell control may be utilized to provide the desired operation.

FIG. 1*a* represents the angle offset required at constant engine speed to yield a constant dwell time, $\tau_{do}$. Plotted vertically is engine position angle and horizontally is time. $\theta_{max}$ represents the maximum allowable angle in a given engine cycle, e.g., 45° of the distributor for an eight cylinder engine. T represents the time corresponding to $\theta_{max}$. $\theta_p$, or the angle predictor, represents the angle with respect to $\theta$max which corresponds to the time $\tau_p$ with respect to the cycle time T such that dwell time $\tau_{do}$ ( $= T - \tau_p$) remains constant. Thus, it is seen that $$\theta_p = \theta_{max} - \omega_0 \cdot \tau_{do},$$

where $\omega_0$ is the angular velocity of the engine.

FIG. 1*b* plots the desired angle offset as a function of time under engine acceleration. Note that the angle increases exponentially with time while the angle predictor $\theta_p$ decreases linearly, since it is proportional to speed which increases linearly under acceleration. Given an acceleration $\alpha$, it can be seen that $$\theta_p = \theta_0 - \omega \cdot \tau_{do} = \beta_0 - [\omega_0 + \alpha \cdot \tau] (\tau_d)$$

A predictor line can be constructed originating at the angle $\theta_0 = \omega_0 \tau_{do}$ and extending to the intersection of the parabolic angle plot with the coordinate $\theta_p$. The horizontal coordinate of the intersection corresponds to the time $\tau_p$ such that $T - \tau_p = \tau_{do}$ (a constant).

Thus, it should be observed that a constant dwell time can be determined based on information as to engine position and a predictor line which originates from the offset angle corresponding to initial engine angular velocity, and descends at a rate dependent upon engine acceleration. In substance then, to maintain a constant dwell time the ignition system must respond to engine position, speed, and acceleration.

FIG. 1*c* illustrates a digital approximation to a constant dwell type system. The approximation assumes that a sequence of digital pulses is generated between ignition pulses. Each digital pulse corresponds to a particular engine angular position. Thus, engine angular position may be determined by counting the number of received position pulses following an ignition pulse. For an accelerating engine, the pulse count will rise at the parabolic rate previously shown in FIG. 1*b*. In turn, engine speed may be determined by counting the number of position pulses generated during a clock interval $T_{clk}$. For a given clock period $T_{clk}$ the number of pulses counted by the speed counter will increase under engine acceleration. Thus, assuming the speed counter starts at an initial count and counts down for each received position pulse during the clock interval, it can be seen that the final decremented count in the speed counter at the end of a clock period traces the angle predictor line. At a given number of clock intervals, the final count in the speed counter will equal the count of the position counter. This corresponds to the angle $\theta_p$ and the time $\tau_p$ that dwell should be initiated if a constant dwell time $\tau_{do}$ is desired. Hence, the time at which the output from the position counter exceeds the output from the speed counter corresponds to the time at which dwell should be initiated.

FIG. 1*d* illustrates the desired angle offset $\theta$ for a system under acceleration and subject to a changing ignition component, such as battery voltage or coil resistance. Assuming that coil resistance decreases, or that battery voltage increases, a corresponding correction to the predicted time $\tau_p$ is easily made by decreasing the clock time $T_{clk}$ to $T'_{clk}$. This results in a new predicted time $\tau_p'$, and a new desired dwell time $\tau_{do}'$.

Figure 2:
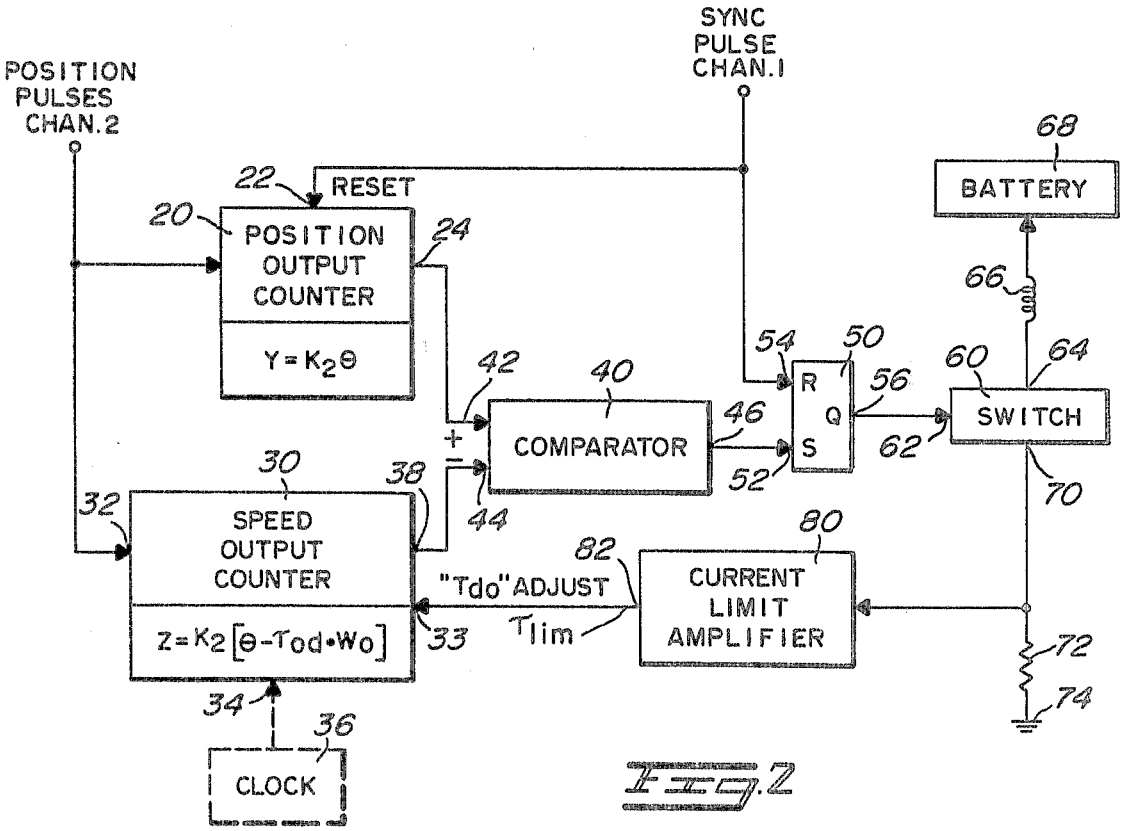
FIG. 2 illustrates the preferred embodiment of the invention in block diagram form.
Figure 1:
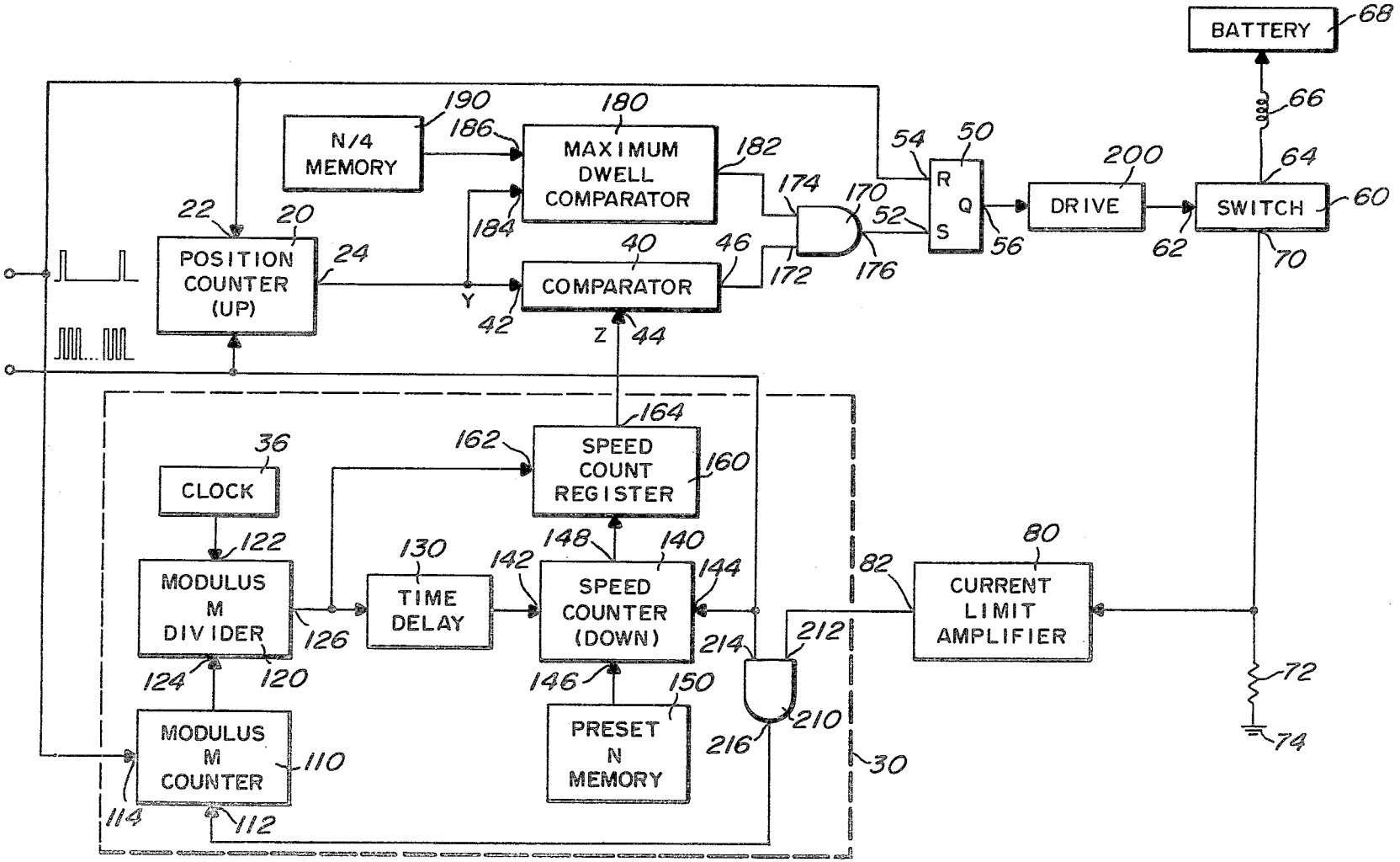

FIG. 2 illustrates a block diagram implementation of the system described with respect to FIG. 1*d*. A first engine sensor (not shown) generates a sync pulse at the desired time of engine firing. The sync pulses are routed to the ignition system via channel I. A series of position pulses are generated by a second sensor (also not shown) and routed to the system via channel II. Each position pulse occurs at a particular engine angular position.

The position pulses are processed through a position output counter 20, which begins at an initial value and increments one count for each received position pulse. A reset input terminal 22 connects to channel I whereby a subsequently received sync pulse resets the counter to its initial value. Thus, the position output counter 20 produces at its output terminal 24 a signal of the form $Y = K_1 + \theta$, where $Y$ is representative of the output signal, $K_1$ represents a constant, and $\theta$ is the engine angular position. The generated signal $Y$ increases at a linear rate when the engine is at constant velocity, and at a parabolic rate for engine acceleration. Hence, output signal $Y$ may be used as representative of the engine position signal indicated in FIGS. 1*a*–1*d*.

Engine speed is determined in a speed output counter 30. Speed counter 30 has a first input 32 which connects to channel II and a second input 34 which connects to a clock 36. At its output 38 the speed output counter 30 produces a signal which is representative of the number of position pulses generated during each clock 36 time period. For a given clock period, the number of position pulses counted increases, thereby increasing the output signal Z. A comparator 40 accepts at its first input 42 the Y signal output from the position counter 20, and at its second input 44 the speed output Z from speed counter 30. When the comparator senses the signal Y is greater than the signal Z it activates its output 46. The output 46 of comparator 40 connects to the "set" terminal 52 of a flip-flop 50. The flip-flop has a "reset" input 54 which connects to channel I, and a Q output 56. An activated comparator output 46 causes the Q output 56 of flip-flop 50 to produce a trigger signal which is coupled to the trigger input terminal 62 of a switch 60. Switch 60 has a first terminal 64 which connects in series through an ignition coil 66 to a battery 68. A second switch terminal 70 connects through a current sense resistor 72 to a reference, or ground, potential 74.

Feedback from the ignition output is provided by a current limit amplifier 80 which connects to the load resistor 72 for sensing the current therethrough. The current limit amplifier 80 produces at its output 82 a signal representative of the time during which the coil 66 is passing a given current level, i.e., a given voltage drop across the load resistor 72. This current limit $\tau_{lim}$ is fed back to the speed output counter 30 its $T_{do}$ adjust input 33.

In operation, comparator 40 activates its output 46 when the position of count Y exceeds speed count Z. Referring to FIG. 1, this corresponds to the time that dwell should be initiated to maintain a constant dwell time. An activated comparator output 46 causes the flip-flop 50 to create a trigger signal which in turn activates switch 60 to its conductive state. Thereafter, current builds up from the battery 68 through ignition coil 66 and load resistor 72 to ground potential 74. When an ignition pulse is generated, it travels via channel I to the reset input 54 of flip-flop 50, thereby deactivating flip-flop output 56 and actuating switch 60 to the nonconductive state. Coil 66 thereby produces a high voltage output which fires the combustion chamber.

A change in battery 68 voltage, or the resistance of ignition coil 66 can significantly alter the rate at which the coil 66 reaches a given current representative of the desired ignition energy level. To compensate for these variables, the current limit amplifier 80 generates a feedback signal representative of the total time the output coil 66 is at the desired current, which feedback signal is applied to the speed output counter 30. In turn, the speed output counter alters its clock period to $T'_{clk}$ thus varying the speed count output Z and thereby altering the time at which the comparator output 46 is activated. This, in turn, adjusts dwell time to maintain a substantially constant ignition energy level.

routed more detailed block diagram of the preferred embodiment of the invention is given in FIG. 3, wherein similar numbers have been used to identify identical components. Position pulses are rounded via channel II to the position counter 20. Counter 20 is of the "up" type whereby each substantially received position pulse increments the counter output 24 to the next higher count state. At the end of a position pulse sequence, a sync pulse via chamber I is applied to the counter reset terminal 22, thereby returning the counter to its initial state in preparation for subsequent counting.

The speed output counter 30 is comprised of a series of individual blocks including a modulus M counter 110, a modulus M divider 120, a time delay 130, a speed counter 140, a preset N memory 150 and a speed count register 160.

Speed output counter operation may be understood as follows. The clock 36 provides a clock signal $\tau_{clk}$ having a frequency $f_0$. This in turn is fed to the input 122 of the modulus M divider 120. Modulus M divider 120 frequency divides signals at its input 122 by the value of modulus M it receives at its input 124 from the modulus M counter 110. This divided output $\tau'_{clk}$ appears at the modulus M divider output 126. There it is fed both to a time delay 130 and to the strobe input 162 of the speed count register 160. After the time delay 130 the count appears at the first input 142 of speed counter 140, whose second input 144 connects to channel II. A third input 146 connects to the preset memory 150. Speed counter 140 produces at its output 148 to count representative of the number of position pulses received at counter input 144 during the time counter input 142 is activated, i.e., during $\tau'_{clk}$ time. Since the output from the speed output counter 30 is only significant at the end of the $\tau'_{clk}$ period, the speed count register 160 is strobed via the trailing edge of the $\tau'_{clk}$ signal to accept the final count from the output 148 of speed counter 140. Once speed counter 140 senses the conclusion of the $\tau'_{clk}$ signal, it activates its third input 146 to preset the counter 140 to the value dictated by preset N memory 150. The preset number N is the maximum number of position pulses that may occur during a cycle. To prevent speed counter 140 from transferring the present number N to the speed count register 160 on the conclusion of every $\tau'_{clk}$ signal, the time delay 130 provides a slight time lag, whereby when the speed count registers strobe 162 is activated, the speed counter output 148 is at or near its maximum value during a $\tau'_{clk}$ interval. The speed count register 160 produces the stored total speed count Z at its output 164.

A comparator 40 couples the Y output from output terminal 24 of position counter 20 to its first input 42, and the Z output of the speed output counter 30 to its second input 44. The comparator 40 logic is such that when the Y count output exceeds the Z count output the comparator activates its output 46.

The comparator output 46 feeds to the first input 172 of an AND gate 170. The AND gate second input 174 connects to the output 182 of a maximum dwell comparator 180. Maximum dwell comparator 180 has its first input 184 connected to the output 24 of position counter 20, and its second input 186 connected to the output of an N/4 memory 190. At the highest desired engine RPM the system should be automatically set to a 75% dwell time. Since N is the total number of pulses per engine cycle, N/4 pulses should be encountered prior to initiating maximum dwell time. Thus, gate 170 produces an activated output 176 over the active RPM range, i.e., 300–5000 rpm, when Y is greater than Z, and when Y is greater than N/4.

The output 176 from gate 170 connects to the set input 52 of flip-flop 50. As discussed with respect to FIG. 2, once input 52 is activated the flip-flop output 56 produces a trigger signal, which is amplified by drive circuitry 200 and applied to the control terminal 62 of a switch 60. Thereafter the switch 60 passes current from the battery 68 through the coil 66 and current sense resistor 72 to ground potential 74. When the reset input 54 of flip-flop 50 receives a sync, or ignition, pulse, the trigger signal at output 56 ceases, whereby the switch 60 opens thus generating the ignition spark via coil 66.

A current limit amplifier 80 monitors the voltage created by coil 66 current through current sense resistor 72. Current limit amp 80 produces at its output 82 a pulse whose width $\tau_{lim}$ is representative of the length of time a predetermined current passes through ignition coil 66. The $\tau_{lim}$ signal is applied to one input 212 of an AND gate 210, whose second input 214 connects to channel II. The gate 210 produces at its output 216 a signal representative of the synchronous occurrence of the $\tau_{lim}$ signal and the input position pulses. Thus as the current limit time increases, as it will for increased battery 68 voltage or decreased coil resistance 66, a greater number of position pulses appears at the gate output 216.

The output of gate 216 is connected to the count down input 112 of the modulus M counter 110. Connected to the up count terminal 114 of modulus M counter 110 are the sync pulses on channel I. During one cycle the modulus M counter 110 up counts via a received sync pulse, and down counts via the number of pulses from gate 210. In stable operation there is one $\tau_{lim}$ pulse per cycle, whereby the modulus M output remains constant. However, should the number of feedback pulses from gate 210 change for a given cycle, the modulus number M from the counter 110 will vary, whereby the modulus M divider 120 will create a correspondingly changed $\tau'_{clk}$ signal. Referring to FIG. 1*d*, as the number of feedback pulses from gate 210 increases per cycle, indicating increased battery voltage or decreased coil resistance, the modulus M is decremented whereby the divider 120 produces a shorter $\tau'_{clk}$ signal at its output 126. As FIG. 1*d* illustrates, this causes the system to initiate dwell at a later point in the cycle, whereby the desired ignition energy level is maintained. In general, the feedback provided by gate 210 and modulus M counter 110 is sufficient to cause the system to always return to a state providing the desired ignition energy.

In summary, an ignition system has been described which maintains a given ignition energy level despite variations in engine acceleration, or temperature, or aging effects on ignition components. Moreover, the entire system may be implemented by digital circuitry, thereby avoiding a large number of age and temperature sensitive components.

While a preferred embodiment of the invention has been described in detail, it should be clear that many modifications and variations thereto are possible, all of which fall within the true spirit and scope of the invention.

I claim:

1. A system for controlling the ignition dwell of an internal combustion engine comprising an ignition pulse generating means, coupled to the engine, and producing ignition pulses suitable for ignition firing, a position pulse generating means coupled to the engine and producing position pulses representative of engine angular position, a first circuit means for producing the position pulses and producing an output signal representative of engine position said first means being resettable to an initial state prior to the occurrence of the first position pulse following a trigger pulse, a second circuit means for processing the position pulses and producing an output representative of engine RPM, a comparator means for comparing the first circuit means output with the second circuit means output and producing a trigger signal in response to a predetermined relationship between the two outputs, switch means for initiating dwell time in response to a trigger signal from the comparator means and firing the ignition in response to an ignition pulse, means for generating a feedback signal representative of the ignition energy level and, control means for predeterminedly altering the occurrence of the trigger signal in response to the feedback signal, whereby the dwell time is adjusted to maintain a substantially constant ignition energy level.

2. The system of claim 1 wherein the first circuit means includes an angle counter for counting the number of position pulses generated between ignition pulses.

3. The system of claim 1 wherein the second circuit means includes clock means for generating a clock signal having a predetermining time period, and speed counter means for counting the number of position pulses generated during each clock signal period.

4. The system of claim 3 wherein the second circuit means further comprises speed register means, responsive to the clock signal, for registering the count of the speed counter means immediately prior to the conclusion of the clock signal, and applying the registered count to the comparator means.

5. The system of claim 4 wherein the second circuit means further comprises means for presetting the speed counter to a predetermined count prior to its reception of position pulses generated during each clock signal period, and wherein the speed counter further comprises means for decrementing the predetermined count by the number of received position pulses during each clock signal period.

6. The system of claim 1 wherein the comparator means includes means for producing a trigger pulse when the output of the first circuit means is greater than or equal to the output of the second circuit means.

7. The system of claim 5 in combination with an ignition coil wherein the feedback signal generating means includes means for generating a circuit limit pulse width of which is representative of the time during which the coil is conducting a predetermined current and, gating means for generating a pulse train representative of the synchronous occurrence of the current limit pulse and the position pulses.

8. The system of claim 7 wherein the control means comprises a modulus M register for generator a modulus number M, the register incrementing the number for each ignition pulse and decrementing its count for each pulse in the pulse train, and means for varying the clock signal period responsive to the modulus number M.

9. The system of claim 8 wherein the control means further comprises an oscillator for producing a signal of constant frequency *fo*, and a modulus M programmable divider, responsive to the modulus M register, for dividing the frequency *fo* by the modulus number M and applying the output clock signal to the speed counter means.

10. The system of claim 1 further comprising means for fixing a maximum allowable dwell time.

11. An adaptive ignition system for an internal combustion engine comprising an ignition coil having primary and secondary windings, the secondary winding providing a high voltage spark suitable for engine firing responsive to current flow in the primary winding, a direct current voltage source means, electronic switch means having a control terminal, the primary winding being series connected between the voltage source and the electronic switch, the switch being operable to conductively couple or nonconductively decouple the primary winding to a reference terminal dependent on signals at the switch control terminal, a sensor for generating a series of pulses indicative of engine angular position, a controlled pulse generator coupled to the electronic switch, the controlled pulse generator providing a pulse having a leading edge suitable for activating the switch to a conducting state and a trailing edge suitable for activating the switch to a nonconductive state, the trailing edge being synchronized to occur at the desired time of engine firing, constant dwell means for maintaining the time duration of the pulse at a predetermined constant interval including means adaptive to changes in the voltage source and the ignition coil to compensate for the same.

12. The adaptive ignition system of claim 11 wherein the constant dwell means comprises means for detecting the period of time during which the primary winding conducts a predetermined current level.

* * * * *